US010927427B2

(12) United States Patent
Chung et al.

(10) Patent No.: US 10,927,427 B2
(45) Date of Patent: Feb. 23, 2021

(54) VACUUM HEAT TREATMENT APPARATUS

(71) Applicant: Won Ki Chung, Seoul (KR)

(72) Inventors: Soo Jin Chung, Seoul (KR); Ji-Young Kang, Incheon (KR); Dong-Ryeol Kim, Siheung-si (KR); Ki Woong Kim, Incheon (KR)

(73) Assignee: Won Ki Chung, Seoul (KR)

( * ) Notice: Subject to any disclaimer, the term of this patent is extended or adjusted under 35 U.S.C. 154(b) by 0 days.

(21) Appl. No.: 15/540,943

(22) PCT Filed: Feb. 16, 2017

(86) PCT No.: PCT/KR2017/001727
§ 371 (c)(1),
(2) Date: Jun. 29, 2017

(87) PCT Pub. No.: WO2018/124380
PCT Pub. Date: Jul. 5, 2018

(65) Prior Publication Data

US 2019/0316217 A1 Oct. 17, 2019

(30) Foreign Application Priority Data

Dec. 29, 2016 (KR) ..... 10-2016-0182375

(51) Int. Cl.
*C21D 1/773* (2006.01)
*F27D 3/12* (2006.01)
(Continued)

(52) U.S. Cl.
CPC ..... *C21D 1/773* (2013.01); *F27D 3/12* (2013.01); *C21D 9/00* (2013.01); *C23C 8/20* (2013.01)

(58) Field of Classification Search
CPC ..... C21D 1/773; C21D 9/00; F27D 3/12
(Continued)

(56) References Cited

U.S. PATENT DOCUMENTS 3,447,788 A * 6/1969 Bornor ..... C21D 1/74 432/2
9,620,269 B2 * 4/2017 Sun ..... H01F 1/0577

FOREIGN PATENT DOCUMENTS

CN 101695834 A 4/2010
CN 202107729 U 1/2012
(Continued)

OTHER PUBLICATIONS

Office Action issued by KIPO dated Apr. 25, 2018 (with English translation) for KR10-2016-0182375.
(Continued)

*Primary Examiner* — Scott R Kastler
*Assistant Examiner* — Michael Aboagye
(74) *Attorney, Agent, or Firm* — Harness, Dickey & Pierce, P.L.C.

(57) ABSTRACT

A vacuum heat treatment apparatus capable of charging or withdrawing an object into or from either a heating chamber or a cooling chamber by a transport means. The vacuum heat treatment apparatus includes: A vacuum heat treatment apparatus, including: a plurality of heating chambers charged with an object and subjected to a heat treatment process; a rail disposed between the plurality of heating chambers; a bogie moving while being disposed on the rail; a cooling chamber disposed on the bogie and cooling the object; and a transport means disposed on the bogie and provided to charge or withdraw the object into or from any one of the plurality of heating chambers and the cooling chamber.

7 Claims, 5 Drawing Sheets

(51) Int. Cl.
*C21D 9/00* (2006.01)
*C23C 8/20* (2006.01)

(58) Field of Classification Search
USPC ..... 266/208, 249, 250, 252, 274; 219/390; 432/198, 205, 24, 242, 246, 56, 85, 92, 432/128, 207
See application file for complete search history.

(56) References Cited

FOREIGN PATENT DOCUMENTS

| | | | | | |
|---|---|---|---|---|---|
| CN | 102925644 | A | | 2/2013 | |
| JP | 3302967 | B2 | | 7/2002 | |
| KR | 101190193 | | * | 10/2012 | ..... C21D 1/773 |
| KR | 101190193 | B1 | | 10/2012 | |

OTHER PUBLICATIONS

Office Action issued by the CNIPA dated May 8, 2019 for corresponding Chinese application 201780000694.0.
Office Action issued by the CNIPA dated Oct. 23, 2019 for corresponding Chinese application 201780000694.0.

* cited by examiner

[Fig. 1]
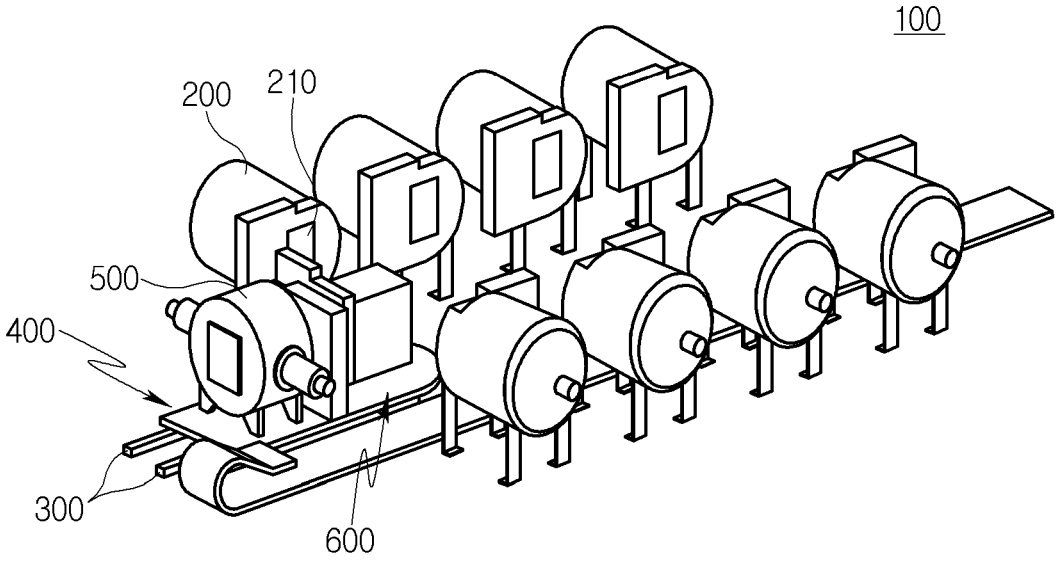

[Fig. 2]
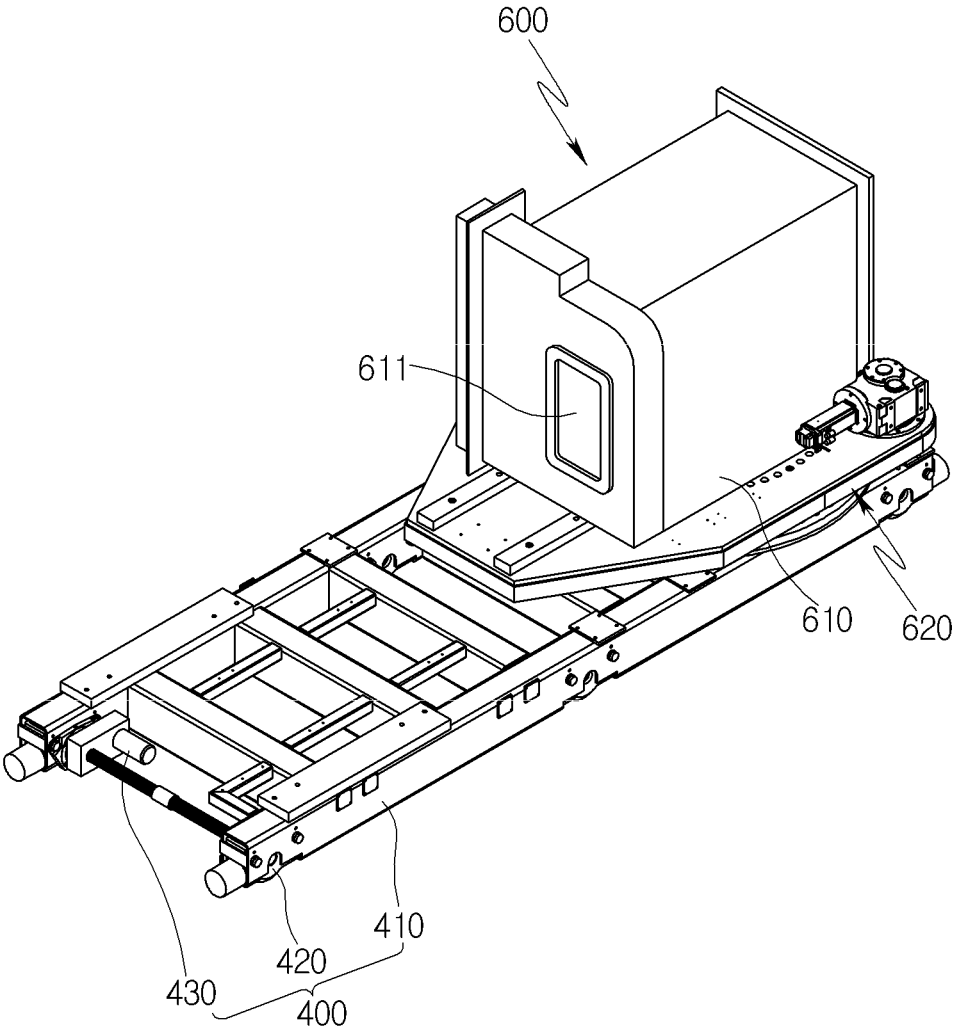

[Fig. 3]
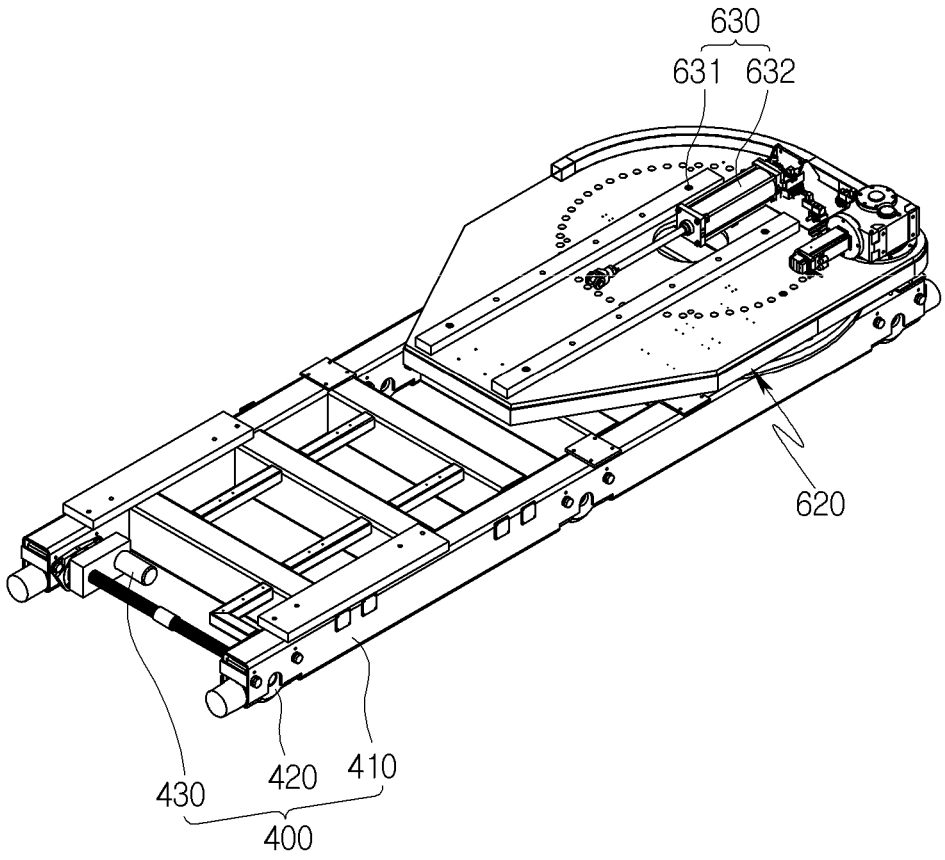

[Fig. 4]
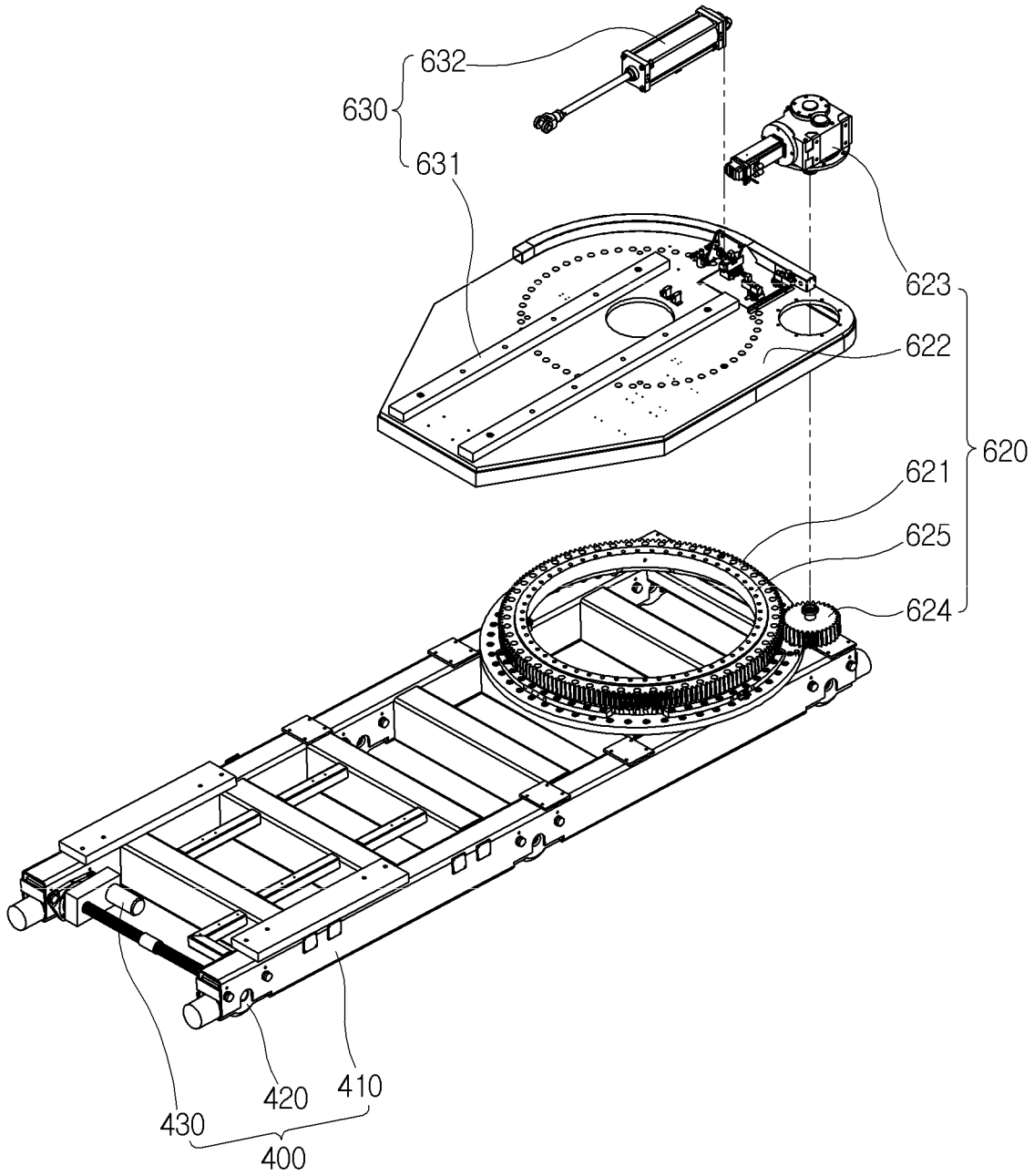

[Fig. 5]
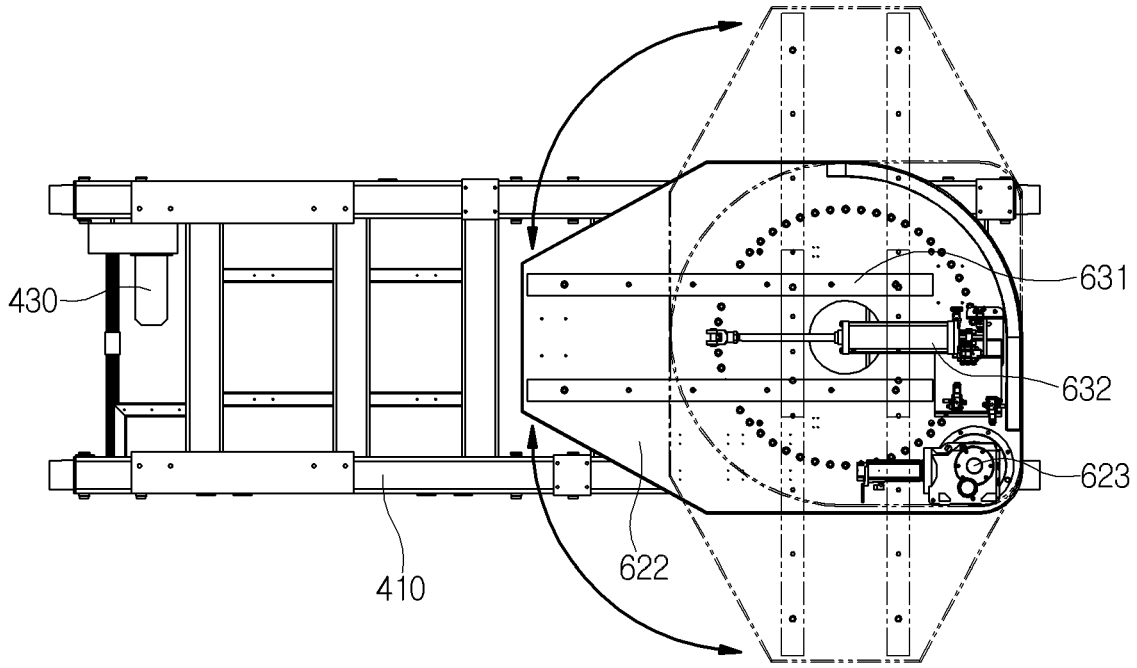

VACUUM HEAT TREATMENT APPARATUS

CROSS-REFERENCE TO RELATED APPLICATIONS

This application is a 371 U.S. National Stage of International Application No. PCT/KR2017/001727, filed Feb. 16, 2017, which claims the benefit of and priority to Korean Patent Application No. 10-20160182375, filed Dec. 29, 2016. The entire disclosures of the above applications are incorporated herein by reference.

TECHNICAL FIELD

Exemplary embodiments of the present invention relate to a vacuum heat treatment apparatus, and more particularly, to a vacuum heat treatment apparatus capable of charging or withdrawing an object into or from any one of a plurality of heating chambers and a cooling chamber by a transport means.

BACKGROUND ART

Generally, a vacuum carburizing method has been successfully evaluated in terms of economic efficiency and quality improvement by remarkably shortening a carburizing time and securing uniformity of a carburizing layer. The vacuum carburization which is a high temperature carburizing process carried out under vacuum is usually performed at a high carburizing temperature of about 800° C. to 1100° C.

The vacuum carburizing method heats a treated product to a set carburizing temperature in a vacuum state, injects hydrocarbon gases such as methane and propane thereinto in the vacuum state to perform carburization with carbon produced during decomposition, again performs the diffusion processing thereon in the vacuum state, and then cooling it by an oil quenching or gas quenching method to repeat the carburization and diffusion processing to thereby making the desired carburizing layer, and then permeating the carbon thereinto while performing the carburization process in a short period of time to thereby obtain a predetermined amount of surface carbon.

Japanese Patent No. 3302967 (hereinafter, referred to as 'Patent Document 1') discloses a vacuum carburizing apparatus capable of carrying out vacuum carburization. The above Patent Document 1 discloses a continuous vacuum carburizing apparatus capable of processing a carburizing process by continuously passing an object through a temperature rising chamber, a carburizing chamber and a diffusion chamber, a temperature-fall keeping chamber, and a cooling chamber.

In the heat treatment process using the continuous vacuum carburizing apparatus, the cooling process performed in the cooling chamber has a very short process time, compared with the carburization and diffusion process performed in the carburizing chamber and the diffusion chamber, and therefore the cooling chamber is not operated for a long period of time.

Therefore, there is a need for a method for more efficiently operating a cooling chamber.

DISCLOSURE

Technical Problem

An object of the present invention is to provide a vacuum heat treatment apparatus capable of charging or withdrawing an object into or from any one of a plurality of heating chambers and a cooling chamber by an operation of a transport means.

Technical Solution

In accordance with one aspect of the present invention, a vacuum heat treatment apparatus, including: a plurality of heating chambers charged with an object and subjected to a heat treatment process; a rail disposed between the plurality of heating chambers; a bogie moving while being disposed on the rail; a cooling chamber disposed on the bogie and cooling the object; and a transport means disposed on the bogie and provided to charge or withdraw the object into or from any one of the plurality of heating chambers and the cooling chamber.

The transport means may include: a transport chamber having the object stored therein and charging or withdrawing the object by contacting any one of the plurality of heating chambers and the cooling chamber; a rotating part disposed on the bogie and rotating the transport chamber; and a moving part provided on the rotating part and linearly moving the transport chamber.

The rotating part may include: a first gear part fastened with the bogie and having gears formed along a circumferential direction; a turntable disposed on the first gear part and rotatably fastened with the bogie; a rotation driving motor fastened with the turntable and generating a torque; and a second gear part fastened with the rotation driving motor and rotating while being engaged with the first gear part.

The moving part may include: a guide rail provided on the turntable and guiding the transporting chamber to linearly move; and an actuator disposed on the turntable and linearly moving the transport chamber.

The bogie may include: a body frame having the cooling chamber and the transport means disposed thereon; a driving roller rotatably fastened with the body frame and disposed on the rail; and a bogie driving motor disposed on the body frame and rotating the driving roller.

The heating chamber may be provided in plural and disposed on both sides of the rail.

The vacuum heat treatment apparatus may further include: a controller controlling the bogie and the transport means when the object is charged or withdrawn into or from any one of the plurality of heating chambers and the cooling chamber.

The controller may control the bogie to position the transport chamber in front of the heating chamber, control the rotating part to direct a door part of the transport chamber toward the heating chamber, and control the moving part so that the door part of the transport chamber comes into close contact with a door part of the heating chamber, when the object is charged or withdrawn into or from any one of the plurality of heating chambers.

The controller may control the rotating part to direct the door part of the transport chamber toward the cooling chamber and control the moving part so that the door part of the transport chamber comes into close contact with the door part of the cooling chamber, when the object is charged or withdrawn into or from the cooling chamber.

Advantageous Effects

According to the vacuum heat treatment apparatus of the present invention, when the heat treatment is sequentially completed in the plurality of heating chambers, the transport means moves to withdraw the object and then charge the object into the cooling chamber to sequentially perform the quenching process, thereby improving the production efficiency.

DESCRIPTION OF DRAWINGS

FIG. 1 is a perspective view schematically illustrating a vacuum heat treatment apparatus according to an embodiment of the present invention;

FIG. 2 is a perspective view schematically illustrating a bogie and a transport means that are extracted from the vacuum heat treatment apparatus according to the embodiment of the present invention;

FIG. 3 is a perspective view schematically illustrating the bogie and a rotating part and a moving part of the transport means that are extracted from the vacuum heat treatment apparatus according to the embodiment of the present invention;

FIG. 4 is an exploded perspective view schematically illustrating the bogie and the rotating part and the moving part of the transport means that are extracted from the vacuum heat treatment apparatus according to the embodiment of the present invention; and FIG. 5 is a plan view schematically illustrating a state in which the rotating part of the transport means in the vacuum heat treatment apparatus according to the embodiment of the present invention is operated.

MODE FOR INVENTION

A vacuum heat treatment apparatus according to an exemplary embodiment of the present invention will be described in more detail in order to assist in understanding of the features of the present invention.

It is to be noted that in adding reference numerals to elements of each accompanying drawing, like reference numerals refer to like elements even though like elements are shown in different drawings. Further, in describing exemplary embodiments of the present invention, when it is determined that detailed description of known functions or configuration may obscure the gist of the present invention, the detailed description will be omitted.

Hereinafter, exemplary embodiments of the present invention will be described in detail with reference to the accompanying drawings.

FIG. 1 is a perspective view schematically illustrating a vacuum heat treatment apparatus according to an embodiment of the present invention and FIG. 2 is a perspective view schematically illustrating a bogie and a transport means that are extracted from the vacuum heat treatment apparatus according to the embodiment of the present invention. FIGS. 3 and 4 are a perspective view and an exploded perspective view schematically illustrating a bogie and a rotating part and a moving part of the transport means that are extracted from the vacuum heat treatment apparatus according to the embodiment of the present invention; FIG. 5 is a plan view schematically illustrating a state in which the rotating part of the transport means in the vacuum heat treatment apparatus according to the embodiment of the present invention is operated.

Referring to FIGS. 1 to 5, a vacuum heat treatment apparatus 100 according to an embodiment of the present invention includes a plurality of heating chambers in which objects (not illustrated) are charged and a heat treatment process is performed, a rail 300 disposed between a plurality of heating chambers, a bogie 400 moving while being disposed on the rail 300, a cooling chamber 500 disposed on the bogie 400 and cooling the object, and a transport means 600 disposed on the bogie 400 and provided to charge or withdraw the object into or from any one of the plurality of heating chambers and the cooling chamber 500.

An inside of the heating chamber 200 may be charged with the object, and the inside of the heating chamber 200 may be formed in a vacuum condition by vacuum exhaust and then is heated to perform the heat treatment on the object. For example, the object may be carburized and diffused in the heating chamber 200. Here, the carburization and diffusion treatment corresponds to the general technique of the carburization process, and therefore a detailed description thereof will be omitted. Obviously, the heat treatment process in the heating chamber 200 is not limited to the carburization and diffusion process, and therefore various known heat treatment processes may be performed.

Further, the heating chambers 200 is provided in plural and disposed on both sides of the rail 300 while being spaced apart from each other at a predetermined interval.

Accordingly, each of the plurality of heating chambers 200 may be subjected to the heat treatment process at a predetermined time interval or the heat treatment under different conditions. For example, the plurality of heating chamber 200 may sequentially start the heat treatment to generate the cooling process at different times and sequentially use the one cooling chamber 500 to perform the cooling process. That is, the cooling process may be performed on the object that is subjected to the heat treatment in the plurality of heating chambers 200 using the one cooling chamber 500.

The rail 300 is disposed between the plurality of heating chambers 200 and the bogie 400 is provided to be movable between the plurality of heating chambers 200.

Further, the bogie 400 is configured to include a body frame 410 having the cooling chamber 500 and the transport means 600 disposed thereon, a driving roller 420 rotatably fastened with the body frame 410 and disposed on the rail 300, and a bogie driving motor 430 disposed on the body frame 410 and rotating the driving roller 420.

By this configuration, when the bogie driving motor 430 is operated, the bogie 400 may rotate the driving roller 420 to move the body frame 410 on the rail 300 in a forward and backward direction, such that the cooling chamber 500 and the transport means 600 may move to the desired position.

That is, when the object is to be charged or withdrawn into or from any one of the plurality of heating chambers 200, the bogie moves so that the transport means is positioned in front of the heating chamber.

The cooling chamber 500 is provided in the body frame 410 of the bogie 400, and when the object is charged into the inside of the bogie 400, the inside of the cooling chamber 500 is supplied with cooling gas and the cooling chamber 500 circulates the supplied cooling gas to cool the object. Obviously, the configuration and the method for cooling the object by the cooling chamber 500 are not limited thereto, and therefore various cooling apparatuses and methods utilizing cooling water or cooling oil may be applied.

The transport means 600 is disposed on the bogie 400 and charges or withdraws the object into or from any one of the plurality of heating chambers 200 and the cooling chambers 500.

For this purpose, the transport means 600 includes a transport chamber 610 having the object stored therein and charging or withdrawing the object by contacting any one of the plurality of heating chambers 200 and the cooling chamber 500, a rotating part 620 disposed on bogie 400 and rotating the transport chamber 610, and a moving part 630 provided on the rotating part 620 and linearly moving the transport chamber 610.

For example, when the heat treatment is completed in the heating chamber 200 and thus the object is withdrawn and charged into the cooling chamber 500, the rotating part 620 rotates the transport chamber 610 so that a door part 611 of the transport chamber 610 is toward a door part 210 of the heating chamber 200 and the moving part 630 moves the transport chamber 610 to the heating chamber 200 so that the door part 611 of the transport chamber 610 and the door part 210 of the heating chamber 200 comes into close contact each other while facing each other to thereby withdraw the object of the heating chamber 200 and charge the withdrawn object into the transport chamber 610.

Further, the moving part 630 moves the transport chamber 610 so that the transport chamber 610 is away from the heating chamber 200, and after the rotating part 620 rotates the door part 611 of the transport chamber 610 so that the door part 611 is toward the door part (not illustrated) of the cooling chamber 500, the moving part 630 brings the transport chamber 610 into contact with the cooling chamber 500 and opens the door part 210 of the heating chamber 200 and the door part 611 of the transport chamber 610 and then charges the object stored in the transport chamber 610 into the cooling chamber 500.

Here, although the configuration for charging or withdrawing into or from the heating chamber 200 or the cooling chamber 500 by the transport chamber 610 is not shown in the drawing, an endless track chain apparatus (not illustrated) may move the heating chamber 200, the cooling chamber 500, and the transport chamber 610 in which the object is charged in a forward and backward direction. In this case, the endless track chain apparatus may be operated to move the object. Alternatively, the transport chamber 610 may be provided with a clamping apparatus (not illustrated) to clamp the object and to charge or withdraw the object into or from the heating chamber 200 or the cooling chamber 500. That is, various mechanical transport methods may be applied to the configuration and the method for charging or withdrawing the object into or from the heating chamber 200 or the cooling chamber 500.

The rotating part 620 is rotatably provided on the bogie 400 to rotate the transport chamber 610. That is, the door part 611 of the transport chamber 610 rotates the transport chamber 610 to be toward the side where the object needs to be charged or withdrawn.

More specifically, the rotating part 620 includes a first gear part 621 fastened with the bogie 400 and having gears formed along a circumferential direction, a turntable 622 disposed on the first gear part 621 and rotatably fastened with the bogie 400, a rotation driving motor 623 fastened with the turntable 622 and generating a torque, and a second gear part 624 fastened with the rotation driving motor 623 and rotating while being engaged with the first gear part 621.

Here, an inside the first gear part 621 is provided with a bearing 625, and the bearing 625 is fastened with the turntable 622 so that the turntable 622 may be rotated.

By this configuration, when the rotation driving motor 623 is operated, the second gear part 624 rotates, and since the second gear part 624 is engaged with the first gear part 621 and the gear part 621 is fixed to the bogie 400, the turntable 622 rotates.

The moving part 630 is provided on the turntable 622 of the rotating part 620 and linearly moves the transport chamber 610. That is, the transport chamber 610 linearly moves to be closely contacted with or away from the heating chamber 200 or the cooling chamber 500.

More specifically, the moving part 630 includes a guide rail 631 provided on the turntable 622 and guiding the transporting chamber 610 to linearly move and an actuator 632 disposed on the turntable 622 and linearly moving the transport chamber 610.

That is, the transport chamber 610 linearly moves on the guide rail 631, and the actuator 632 is fastened with the transport chamber 610 to move the transport chamber 610 in a linear direction.

Further, the vacuum heat treatment apparatus 100 according to the embodiment of the present invention may further include a controller (not illustrated) controlling the bogie 400 and the transport means 600 when the object is charged or withdrawn into or from any one of the plurality of heating chambers 200 and the cooling chamber 500. That is, the controller may perform the charging and withdrawing operation of the object automatically.

For example, when the object is charged or withdrawn into or from any one of the plurality of heating chambers 200, the controller controls the bogie 400 to position the transport chamber 610 in front of the heating chamber, controls the rotating part 620 to direct the door part 611 of the transport chamber 610 toward the heating chamber 200, and controls the moving part 630 so that the door part 611 of the transport chamber 610 comes into close contact with the door part 210 of the heating chamber 200.

Further, when the object is charged in the cooling chamber 500 for the cooling process or the cooling process is completed to withdraw the object, the controller controls the rotating part 620 to direct the door part 611 of the transport chamber 610 toward the cooling chamber 500 and controls the moving part 630 so that the door part 611 of the transport chamber 610 comes into close contact with the door part (not illustrated) of the cooling chamber 500.

By this configuration, when the transport chamber 610 moves through the bogie 400 provided between the plurality of heating chambers and the transport chamber 610 is positioned in front of the heating chamber 200 to which the heat treatment is subjected among the plurality of heating chambers, the transport chamber 610 comes into close contact with the heating chamber 200 by the rotating part 620 and the moving part 630 to withdraw the object from the heating chamber 200 and then charge the withdrawn object into the cooling chamber 500 disposed on the bogie 400 to perform the quenching, such that only one cooling chamber 500 may effectively perform the heat treatment process on the plurality of heating chambers.

As described above, although the present invention has been described with reference to exemplary embodiments and the accompanying drawings, it would be appreciated by those skilled in the art that the present invention is not limited thereto but various modifications and alterations might be made without departing from the scope defined in the following claims.

The invention claimed is:

1. A vacuum heat treatment apparatus, comprising:

a plurality of heating chambers charged with an object, and the object is subjected to a heat treatment process;

a rail having one or more sides, wherein the plurality of heating chambers includes one or more first heating chambers disposed on a first side of the rail and one or more second heating chambers disposed on a second side of the rail such that the rail is disposed between two or more heating chambers of the plurality of heating chambers;

a bogie disposed on the rail and configured to move on the rail;

a cooling chamber disposed on the bogie and configured for cooling the object; and a transport means disposed on the bogie and provided to charge or withdraw the object into or from any one of the plurality of heating chambers and the cooling chamber, wherein the transport means includes:

a transport chamber having the object stored therein and charging or withdrawing the object by contacting any one of the plurality of heating chambers and the cooling chamber;

a rotating part disposed on the bogie and configured for rotating the transport chamber toward any one of the plurality of heating chambers and the cooling chamber; and a moving part provided on the rotating part and linearly moving the transport chamber to contact any one of the plurality of heating chambers and the cooling chamber.

2. The vacuum heat treatment apparatus of claim 1, wherein the rotating part includes:

a first gear part fastened to the bogie and having gears formed along a circumferential direction;

a turntable disposed on the first gear part and rotatably fastened to the bogie;

a rotation driving motor fastened to the turntable and generating a torque; and a second gear part fastened to the rotation driving motor and rotating while being engaged with the first gear part.

3. The vacuum heat treatment apparatus of claim 2, wherein the moving part includes:

a guide rail provided on the turntable and configured for guiding the transporting chamber to linearly move; and an actuator disposed on the turntable and configured for linearly moving the transport chamber.

4. The vacuum heat treatment apparatus of claim 1, wherein the bogie includes:

a body frame having the cooling chamber and the transport means disposed thereon;

a driving roller rotatably fastened with the body frame and disposed on the rail; and a bogie driving motor disposed on the body frame and configured for rotating the driving roller.

5. The vacuum heat treatment apparatus of claim 1, further comprising:

a controller configured for controlling the bogie and the transport means when the object is charged or withdrawn into or from any one of the plurality of heating chambers and the cooling chamber.

6. The vacuum heat treatment apparatus of claim 5, wherein the controller controls the bogie to position the transport chamber in front of the heating chamber, controls the rotating part to direct a door part of the transport chamber toward the heating chamber, and controls the moving part so that the door part of the transport chamber comes into close contact with a door part of the heating chamber, when the object is charged or withdrawn into or from any one of the plurality of heating chambers.

7. The vacuum heat treatment apparatus of claim 5, wherein the controller controls the rotating part to direct the door part of the transport chamber toward the cooling chamber and controls the moving part so that the door part of the transport chamber comes into close contact with the door part of the cooling chamber, when the object is charged or withdrawn into or from the cooling chamber.

* * * * *